US010180287B2

(12) United States Patent
Sweet et al.

(10) Patent No.: US 10,180,287 B2
(45) Date of Patent: Jan. 15, 2019

(54) EXHAUST GAS COOLER

(71) Applicant: Modine Manufacturing Company, Racine, WI (US)

(72) Inventors: Brian Sweet, Franklin, WI (US); Thomas R Grotophorst, Muskego, WI (US)

(73) Assignee: MODINE MANUFACTURING COMPANY, Racine, WI (US)

( * ) Notice: Subject to any disclaimer, the term of this patent is extended or adjusted under 35 U.S.C. 154(b) by 599 days.

(21) Appl. No.: 14/308,849

(22) Filed: Jun. 19, 2014

(65) Prior Publication Data

US 2014/0373517 A1 Dec. 25, 2014

Related U.S. Application Data

(60) Provisional application No. 61/837,736, filed on Jun. 21, 2013.

(51) Int. Cl.

| | |
|---|---|
| ***F28F 9/02*** | (2006.01) |
| ***F28D 21/00*** | (2006.01) |
| ***F28D 7/16*** | (2006.01) |
| ***F02M 26/32*** | (2016.01) |

(52) U.S. Cl.

CPC ..... *F28D 21/0003* (2013.01); *F02M 26/32* (2016.02); *F28D 7/1684* (2013.01); *F28F 9/02* (2013.01); *F28F 9/0219* (2013.01); *F28F 2009/029* (2013.01); *F28F 2265/10* (2013.01)

(58) Field of Classification Search

CPC .. F28F 9/0248; F28F 9/0219; F28F 2009/029; F28F 2265/10; F01N 3/2892; F28D 21/0003; F02M 26/32

See application file for complete search history.

(56) References Cited

U.S. PATENT DOCUMENTS

| | | | | |
|---|---|---|---|---|
| 4,002,433 A * | 1/1977 | Oser | ..... | F01N 3/2853 422/176 |
| 4,927,608 A * | 5/1990 | Worner | ..... | F01N 3/2857 422/179 |
| 5,408,828 A * | 4/1995 | Kreucher | ..... | F01N 3/2892 422/176 |

(Continued)

FOREIGN PATENT DOCUMENTS

| | | |
|---|---|---|
| EP | 0406774 | 1/1991 |
| JP | 11237192 | 8/1999 |
| WO | 2008003486 | 1/2008 |

OTHER PUBLICATIONS

Chinese Patent Office Action for Application No. 201410279825.1 dated Aug. 1, 2017 (16 pages, English translation included).

(Continued)

*Primary Examiner* — Devon Russell
(74) *Attorney, Agent, or Firm* — Michael Best & Friedrich LLP; Jeroen Valensa; Michael Bergnach

(57) ABSTRACT

An exhaust gas cooler includes tubes to convey an exhaust gas through the cooler, a header plate to receive ends of the tubes, and a diffuser. The diffuser and the header plate together define an inlet plenum for the exhaust gas. The diffuser includes a connection flange to join the diffuser to the header plate, and the connection flange is substantially shielded from the flow of exhaust gas passing through the inlet plenum.

20 Claims, 6 Drawing Sheets

(56) References Cited

U.S. PATENT DOCUMENTS 6,010,668 A * 1/2000 Lawrence ..... F01N 3/2839 422/176
6,128,821 A * 10/2000 Grescher ..... B01D 53/945 29/446
6,220,021 B1 * 4/2001 Frederiksen ..... F01N 1/003 422/176
6,595,274 B2 * 7/2003 Hayashi ..... F01N 5/02 123/568.12
6,712,869 B2 * 3/2004 Cheng ..... B01D 46/0043 422/176
6,892,854 B2 * 5/2005 Wagner ..... F01N 1/003 181/249
7,121,325 B2 * 10/2006 Kruger ..... F28F 9/02 123/568.12
7,323,030 B2 * 1/2008 Andersen ..... F01N 3/0211 422/168
7,451,594 B2 * 11/2008 Blaisdell ..... F01N 1/003 60/299
7,611,561 B2 * 11/2009 Hill, Jr. ..... F01N 3/0211 422/168
7,779,624 B2 * 8/2010 Belisle ..... F01N 3/0211 60/297
8,652,599 B2 * 2/2014 Braunreiter ..... B29C 51/10 106/711
9,222,392 B2 * 12/2015 Schwarz ..... F01N 3/2867
9,458,747 B2 * 10/2016 Mutsuda ..... F01N 3/2013
2003/0010480 A1 * 1/2003 Shibagaki ..... F28D 7/1684 165/158
2004/0188070 A1 9/2004 Kruger et al.
2004/0258583 A1 * 12/2004 Hardesty ..... F01N 3/2853 422/179
2006/0070236 A1 * 4/2006 Barnard ..... F01N 3/28 29/890
2009/0200003 A1 8/2009 Digele
2010/0071871 A1 * 3/2010 Gaensler ..... F28D 7/1653 165/51
2011/0011376 A1 * 1/2011 Meshenky ..... F02B 29/0462 123/568.12
2013/0022513 A1 1/2013 Yoshioka et al.
2013/0183205 A1 * 7/2013 Yoshioka ..... F01N 3/2026 422/199
2013/0336847 A1 12/2013 Yoshioka

OTHER PUBLICATIONS

Chinese Patent Office Action for Application No. 201410279825.1 dated Feb. 24, 2018 (15 pages, English translation included).

* cited by examiner

EXHAUST GAS COOLER

CROSS REFERENCE TO RELATED APPLICATIONS

This application claims priority to U.S. Provisional Patent Application No. 61/837,736, filed on Jun. 21, 2013, the entirety of which is hereby incorporated herein by reference.

BACKGROUND

Emission concerns associated with the operation of internal combustion engines (e.g., diesel and other types of engines) have resulted in an increased emphasis on the use of exhaust gas heat exchangers. These heat exchangers are often used as part of an exhaust gas recirculation (EGR) system, in which a portion of an engine's exhaust is returned to the combustion chambers. Such a system displaces some of the oxygen that would ordinarily be inducted into the engine as part of the fresh combustion air charge with the inert gases of the recirculated exhaust gas. The presence of the inert exhaust gas typically serves to lower the combustion temperature, thereby reducing the rate of $NO_x$ formation.

In order to achieve the foregoing, it is desirable for the temperature of the recirculated exhaust to be lowered prior to the exhaust being delivered into the intake manifold of the engine. In the usual case, engine coolant is used to cool the exhaust gas within the exhaust gas heat exchanger in order to achieve the desired reduction in temperature. The use of engine coolant provides certain advantages in that appropriate structure for subsequently rejecting heat from the engine coolant to the ambient air is already available for use in most applications requiring an EGR system.

Due in large part to the elevated temperatures of the exhaust gas that they encounter, exhaust gas coolers are known to be prone to thermal cycle failure. The desire for increased fuel economy continues to drive the engine operating temperatures upward, further exacerbating the problem. Above a certain temperature, the material properties of the metals used to produce the heat exchanger rapidly degrade, and the operational lifetime of the heat exchanger is substantially reduced. In order to combat this problem, it often becomes necessary either for the heat exchanger to be produced of more expensive alloys that can withstand these higher temperatures, or to increase the size and weight of the heat exchanger using the current materials, neither of which is desirable. Thus, there is still room for improvement.

SUMMARY

An exhaust gas cooler according to an embodiment of the invention includes tubes to convey an exhaust gas through the cooler, a header plate to receive ends of the tubes, and a diffuser. The diffuser and the header plate together define an inlet plenum for the exhaust gas. The diffuser includes a connection flange to join the diffuser to the header plate, and the connection flange is substantially shielded from the flow of exhaust gas passing through the inlet plenum.

According to some embodiments, the diffuser includes an inlet end to receive the exhaust gas into the cooler and an outlet end to deliver the exhaust gas to the tubes. A diffuser body extends between the inlet end and the outlet end, and the connection flange is connected to the diffuser body at a location between the inlet end and the outlet end. In some such embodiments that location is between five millimeters and twenty millimeters from the outlet end. In some embodiments the connection flange includes a first portion extending out from the diffuser body, and a second portion connected to the first portion and oriented at an angle to the first portion.

In some embodiments, the diffuser includes a first component at least partially defining the diffuser body, and a second component joined to the first component and at least partially defining the connection flange. In some such embodiments the second component at least partially defines the diffuser body. The second component can be a formed sheet metal component in some embodiments. The second component can have a U-shaped, an L-shaped, or a Z-shaped profile in some embodiments.

According to another embodiment of the invention, an exhaust gas cooler has tubes to convey an exhaust gas flow, a header plate to receive ends of the tubes, and a diffuser. The diffuser includes an inlet end to receive the exhaust gas into the cooler, an outlet end to deliver the exhaust gas to the plurality of tubes, a diffuser body extending between the inlet end and the outlet, and a connection flange to join the diffuser to the header plate. The connection flange is located externally from the diffuser body and is connected thereto at a location between the inlet end and the outlet end.

In some embodiments the joint between the connection flange and the header plate defines a continuous leak-free seal for the exhaust gas. In some embodiments the location between the inlet end and the outlet end is between five millimeters and twenty millimeters from the outlet end.

In some embodiments the connection flange defines a conduction path length between the diffuser body and the header plate, and that conduction path length is at least three times the mean thickness of the connection flange. In some embodiments the connection flange and the diffuser body are an integral casting. In some embodiments the connection flange is joined to the header plate by a continuous weld joint, and in some such embodiments the continuous weld joint additionally joins an end of a housing surrounding the tubes to the header plate.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
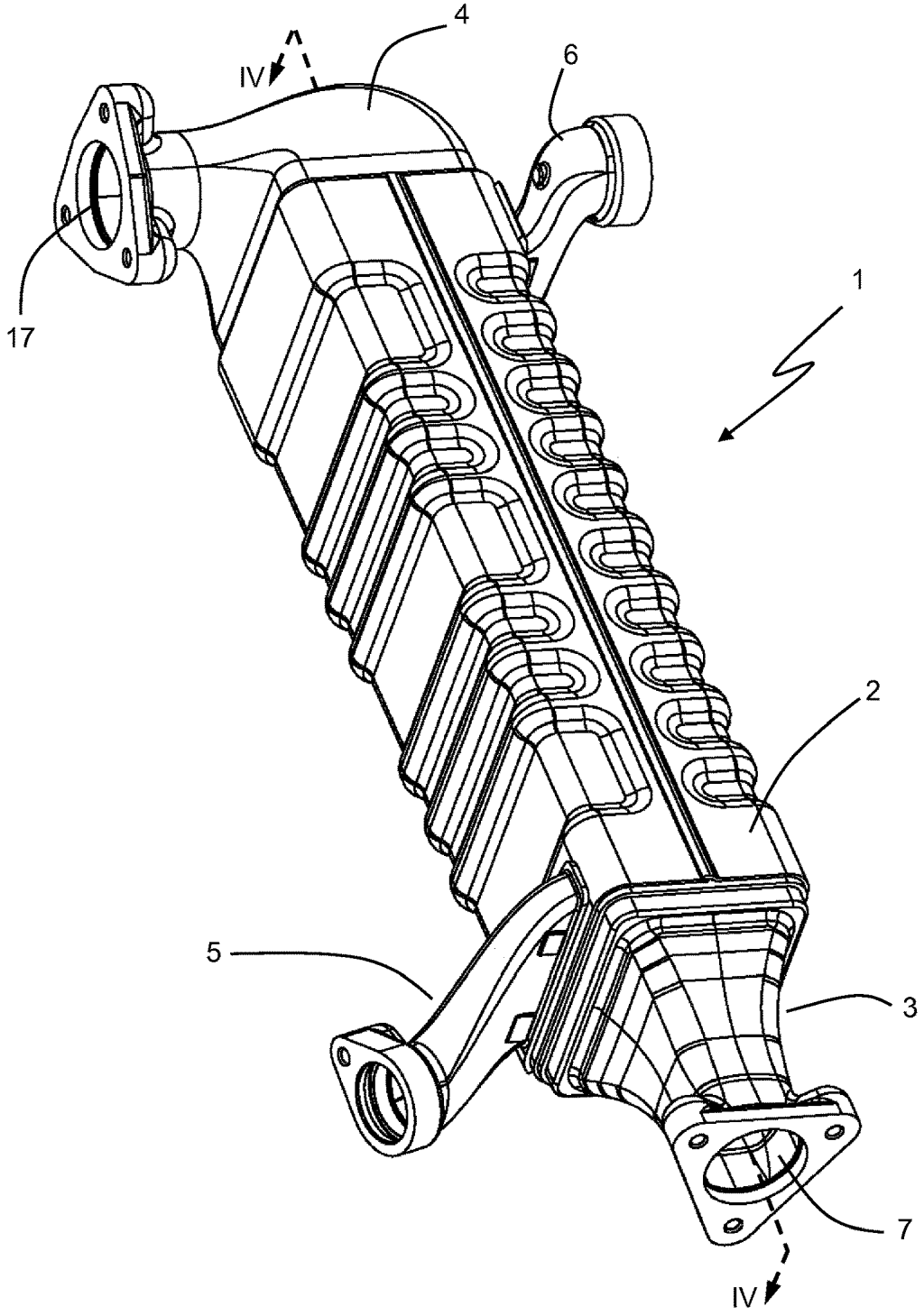
FIG. 1 is a perspective view of an exhaust gas cooler according to an embodiment of the present invention.
Figure 2:
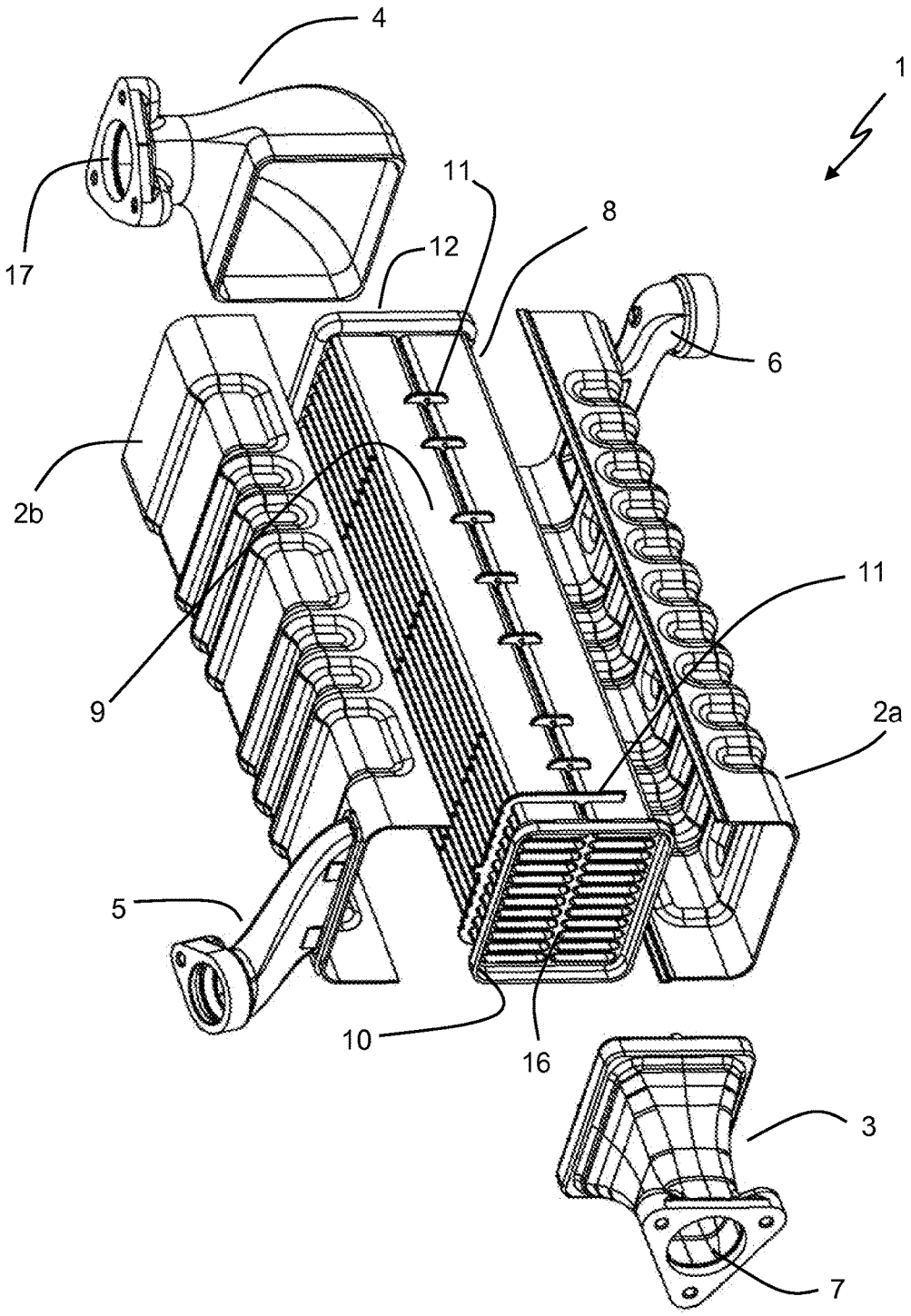
FIG. 2 is an exploded perspective view of the exhaust gas cooler of FIG. 1.

An exhaust gas cooler 1 according to an embodiment of the invention is depicted in FIGS. 1-2, and includes a heat exchanger core 8 surrounded by a casing 2. The heat exchanger core 8 is of a stainless steel construction, and includes multiple tubes 9 disposed in an array to convey the exhaust gas through the heat exchanger core 2. The tubes 9 are spaced apart from one another in order to allow for a flow of coolant contained within the casing 2 to pass over the outer surfaces of the tubes 9, thereby cooling the exhaust gas traveling through the tubes. Baffles 11 are further included in the heat exchanger core 8 to support the tubes 9 along their length, as well as to guide the flow of coolant. While the tubes 9 shown in the illustrated embodiment are of a flattened rectangular design, it should be understood by those skilled in the art that the tubes 9 can similarly take on other shapes, including round, oval, etc.

The tubes 9 extend between a header plate 10 arranged at one end of the heat exchanger core 8, and a header plate 12 arranged at the opposing end of the heat exchanger core 8. Each of the header plates 10, 12 include a series of slots 16 sized and arranged so as to be compatible with ends of the tubes 9, so that respective ends of the tubes 9 can be received into the slots 16. Once received into the header plates 10 and 12, the ends of the tubes 9 are joined to the header plates 10 and 12 to provide a leak free path for the exhaust gas between the header plates.

The heat exchanger core 8 can in some embodiments be provided as a brazed assembly of the tubes 9, baffles 11, and header plates 10 and 12. Inserts (not shown) can optionally be provided within the tubes 9 in order to increase the heat transfer surface area, the heat transfer coefficient, or both.

An inlet diffuser 3 is joined to the header plate 10, and provides a flow path to deliver the exhaust gas to the ends of the tubes 9 received into the header plate 10. Similarly, an outlet diffuser 4 is joined to the header plate 12, and provides a flow path for the exhaust from the ends of the tubes 9 received into the header plate 12 to an exhaust outlet 17. The inlet diffuser 3 and outlet diffuser 4 can be coupled within an exhaust system to provide a flow of exhaust through the exhaust cooler 1.

The casing 2 is provided in two parts 2*a* and 2*b*, which are joined to the heat exchanger core 8 in order to provide a sealed volume for the flow of coolant. Alternatively, the casing 2 can be provided as a single component into which the heat exchanger core 8 is inserted. Coolant inlet and outlet ports 5 and 6 are provided in the casing in order to deliver the coolant into, and remove the coolant from, the cooler 1. The coolant can pass through the cooler 1 in a counter-flow orientation to the exhaust gas by having the port 6 function as the coolant inlet port and the port 5 as the coolant outlet port, or in a concurrent-flow orientation by having the port 5 function as the coolant inlet port and the port 6 as the coolant outlet port. In other embodiments the ports 5 and 6 can be alternately arranged to achieve other flow orientations such as, for example, cross-flow or combinations of counter-flow, concurrent-flow, and/or cross-flow.

Figure 3:
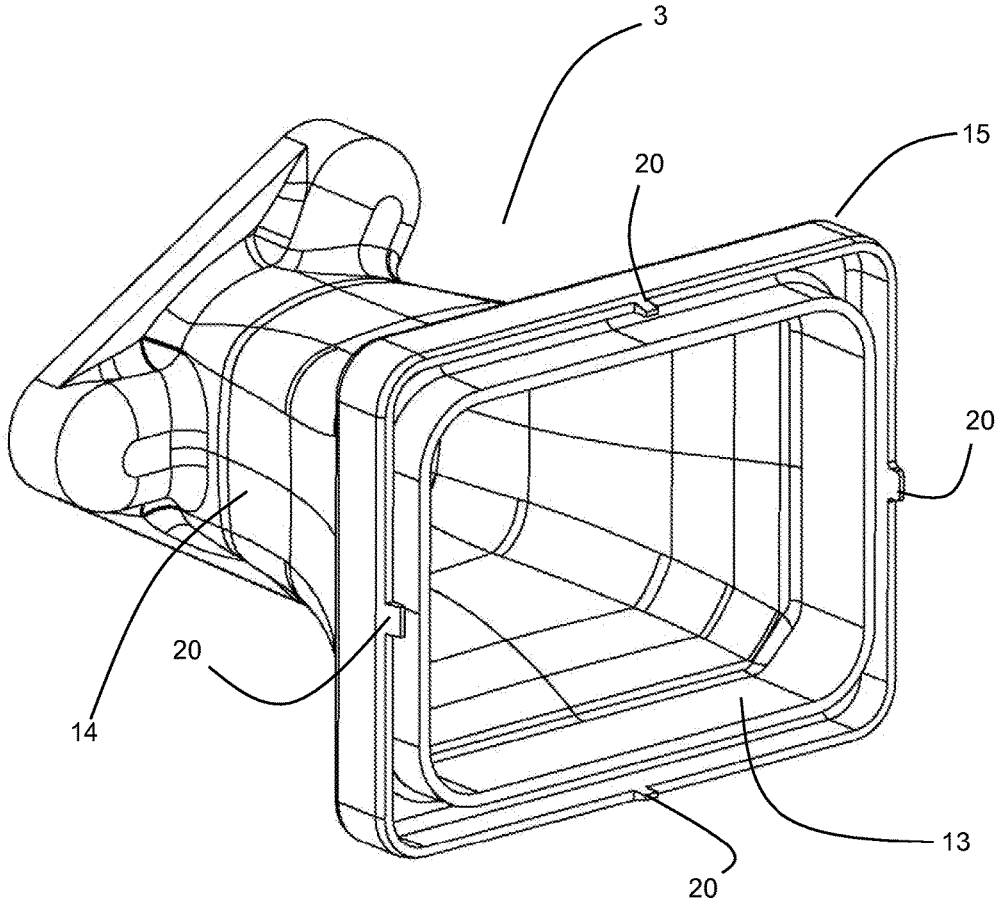
FIG. 3 is a perspective view of a diffuser according to an embodiment of the present invention.
Figure 4:
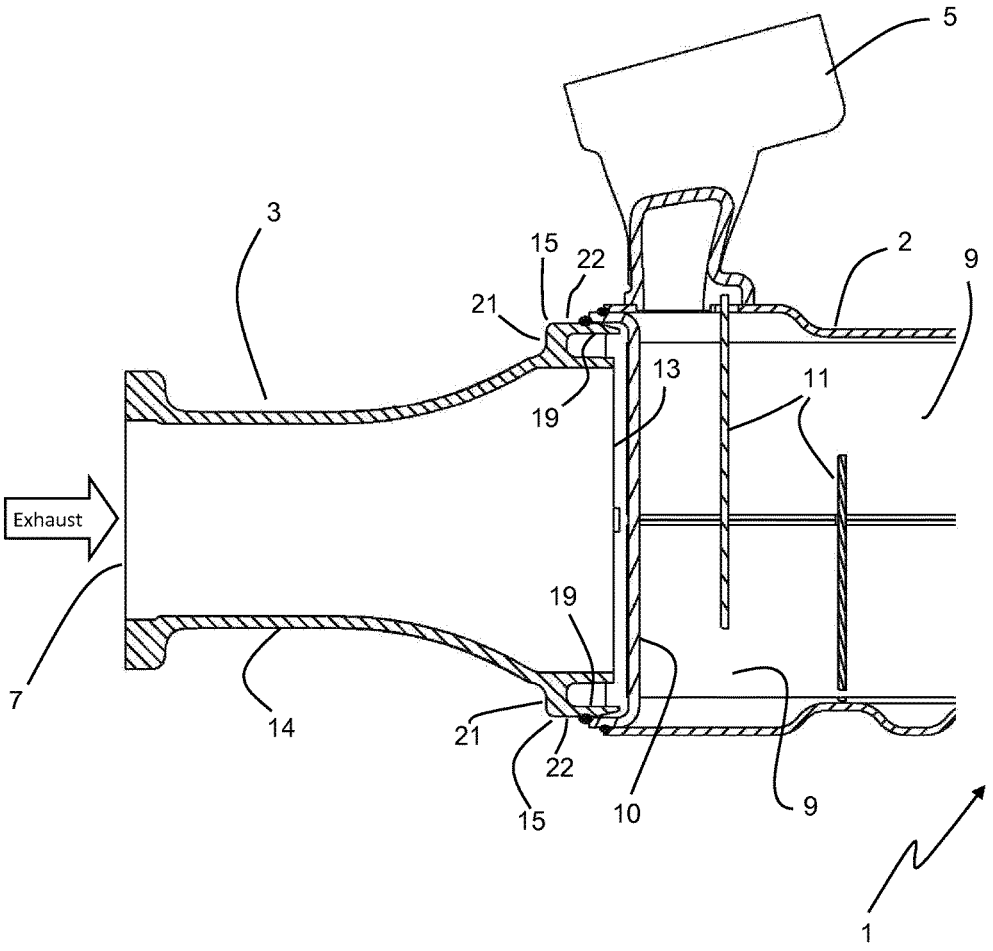
FIG. 4 is a partial cross-sectional elevation view along the lines IV-IV of FIG. 1.
Figure 5:
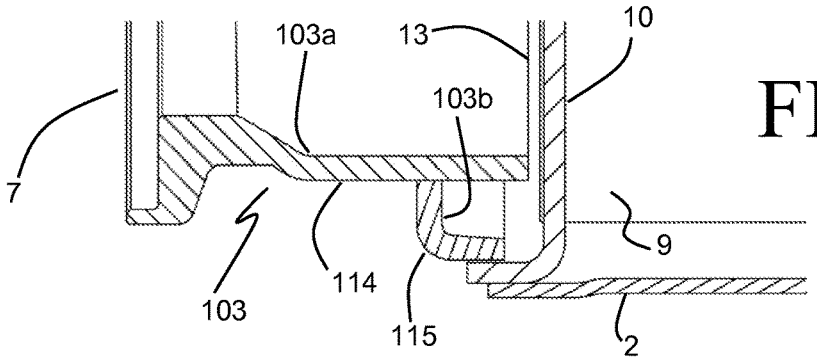
FIGS. 5-9 are variations of FIG. 4 showing alternate embodiments of the invention.

Turning now to the inlet diffuser 3 in more detail, and with specific reference to FIGS. 3 and 4, it can be seen that the diffuser 3 extends between an exhaust inlet end 7 and an exhaust outlet end 13. The exhaust inlet end 7 and exhaust outlet end 13 are spaced apart from one another and are joined by a diffuser body 14 disposed between the ends. The diffuser body 14 can have a profile that is shaped to provide a smooth transition between the exhaust inlet end 7 and the exhaust outlet end 13. Such a smooth transition can provide benefit by preventing maldistribution of the exhaust gas flow as the flow conduit transitions from a shape and size corresponding to the exhaust piping (e.g. the circular flow area of the inlet end 7) to a shape and size approximately corresponding to the inlet ends of the array of tubes 9. The diffuser body can define a diverging profile as shown, or can define a converging profile, or can define some other profile, depending on the amount of transition required and the available space.

The diffuser 3 further includes a connection flange 15 joined to the diffuser body 14 at a location between the inlet end 7 and the outlet end 13. The location between the inlet end 7 and the outlet end 13 at which the connection flange 15 joins to the diffuser body 14 can vary, but is preferably closer to the outlet end 13 than to the inlet end 7. In some especially preferable embodiments that location is between five millimeters and 20 millimeters from the outlet end 13. The connection flange 15 extends continuously around the periphery of the diffuser 3 and is joined to the header 10 by brazing, welding, or other joining processes known in the art. In some embodiments the connection flange 15 can be joined to the header 10 in a removable or serviceable manner, such as by a gasketed mechanical joint. In any event, it is desirable for the joint between the connection flange 15 and the header 10 to define a continuous leak-free seal for the exhaust gas, so that the diffuser 3 and the header 10 together define an inlet plenum for the exhaust gas into which the open ends of the tubes 9 extend.

As best seen in FIG. 4, the connection flange 15 includes a first portion 21 that extends outwardly from the diffuser body and is joined thereto. A second portion 22 is joined to the portion 21, and is arranged at an angle to that portion 21, so that the portions 21 and 22 together define a nonlinear profile of the connection flange 15. As shown in the embodiment of FIG. 4, the portions 21 and 22 are arranged at an approximately 90 degree angle to each other so that the nonlinear profile of the connection flange 15 approximates an "L" shape, although it should be recognized that angles deviating from 90 degrees would be similarly achievable.

The casing 2 is also joined to the outer periphery of the header plate 10. This joint between the casing 2 and the header plate 10 can, in some embodiments, be combined with the joint between the header plate 10 and the diffuser 3 to define a single joint. For example, a single continuous weld bead can be used to join all three components simultaneously. Alternatively, a clamped joint can be used that captures the header plate 10 between the casing 2 on the one side, and the connection flange 15 of the diffuser on the other.

When the exhaust gas cooler 1 is used in an EGR system, high temperature recirculated exhaust gas from the exhaust manifold of the engine is directed through the array of tubes 9, and is cooled by engine coolant circulating over the array of tubes 9. In typical diesel engine applications the temperature of the exhaust gas is reduced from an inlet temperature of 600-700° C. to an outlet temperature of 100-150° C., while the temperature of the coolant is maintained at a fairly uniform temperature of approximately 90° C. by providing a sufficiently high coolant flow rate through the exhaust gas cooler 1. Maintaining such a high coolant flow rate is preferable so that undesirable boiling of the liquid coolant is prevented.

As a consequence of the high coolant flow rate, the temperatures of those portions of the exhaust gas cooler that are exposed to the coolant are held to a temperature that is fairly close to the coolant temperature. For example, the casing 2 is able to be maintained at a temperature that is approximately the coolant temperature. The header plate 10, while exposed to the hot incoming exhaust on one side, is aggressively cooled by the coolant passing over the opposing surface, and is likewise maintained at a temperature that is substantially nearer to the coolant temperature than it is to the incoming exhaust gas temperature, especially at those portions of the header plate 10 that are furthest removed from the exhaust gas conveying tubes 9.

By contrast, the inlet diffuser 3, being directly exposed to the hot incoming exhaust gas but not at all to the coolant, reaches temperatures that are substantially higher than those portions of the cooler previously mentioned. In previously known configurations of EGR coolers, which lack the connection flange 15 of the exhaust gas cooler 1, the diffuser body is typically connected directly to the header plate. With such a configuration that portion of the diffuser body that is directly connected to the header plate is cooled by the conduction of heat from the diffuser to the aggressively cooled header plate, but the diffuser is still heated, by the flow of exhaust gas passing therethrough, to a substantially higher temperature than is the header plate. This substantially higher temperature of the diffuser relative to the header plate likewise leads to a substantially greater thermal expansion of the diffuser relative to the header plate, resulting in mechanical strain being produced in the header plate. This mechanical strain tends to be greatest at the intersection of the exhaust tubes and the header plate due to geometric stress concentrations occurring at these intersections.

EGR coolers are known to be highly susceptible to thermal fatigue induced failure modes. The flow of exhaust gas through an EGR cooler tends to vary somewhat directly with the engine output, and highly cyclic patterns of exhaust gas flow can result from typically encountered driving patterns. While the temperatures of those portions of the EGR cooler that are aggressively cooled by the coolant (e.g. the casing 2 and the header plate 10, among others) are maintained at a fairly constant temperature, the inlet diffuser can be alternately aggressively heated by the flowing exhaust gas and rapidly cooled by conduction in the absence of high exhaust gas flow. This cyclic behavior, and the resulting variation in mechanical strain in the header plate, is known to lead to thermal stress fatigue of the EGR cooler, and eventual failure of the device.

In contradistinction to the above described behavior of previously known configurations of EGR coolers, an exhaust gas cooler 1 according to embodiments of the present invention has an inlet diffuser body 14 that is thermally coupled to the header plate 10 in a less direct fashion. The connection flange 15 provides a more resistive thermal conduction path from the diffuser body 14 to the header plate 10. As a result, the diffuser body 14 is maintained at an elevated temperature near to the incoming exhaust gas temperature over its entire length during those portions of the cycle where exhaust gas is flowing through the cooler 1 at a high rate. This increased temperature tends to result in slightly higher mechanical strain values in the header plate 10 than are found in the previously known EGR coolers. However, during periods of low exhaust gas flow, the more resistive thermal conduction path that is provided by the connection flange leads to a lower rate of cooling of the diffuser body. Consequently, the cyclic variation in mechanical strain is reduced. Calculations have shown that the strain range (i.e. the variation in mechanical strain between the high exhaust flow condition and the low exhaust flow condition) at the tube to header intersection can be reduced by as much as 25%, which can lead to a substantial increase in the expected life of the cooler.

In order to maximize the beneficial effect of the diffuser 3, the inner surfaces 19 of the connection flange 15 should be shielded as much as possible from the direct heating effects of the exhaust gas passing through the diffuser 3. To that end, it can be beneficial for the outlet end 13 of the diffuser body 14 to be located in close proximity to the header plate 10 so that relatively little of the exhaust gas flow passes through the resulting gap to the surfaces 19. In some embodiments the end 13 can be made to directly abut the header plate 10, while in other embodiments the end 13 needs to be spaced back in order to accommodate for the extension of the ends of the tubes 9 beyond the plane of the header plate 10. Tabs 20 (FIG. 3) can be placed at locations along the connection flange 15 to engage the header plate and provide a positive stop location for the assembly of the diffuser 3. Alternatively, such tabs 20 can be provided at locations along the end 13 of the diffuser body 14, such locations being selected so as to not interfere with the ends of the tubes 9. The resulting small gap is sufficient to substantially shield the inner surfaces 19 from the flowing exhaust gas, so that those surfaces 19 are not aggressively heated by the exhaust gas during periods of high exhaust gas flow.

The thermal resistance value of a heat conducting body is known to be directly proportional to the length of the thermal conduction path, and inversely proportional to the thickness of the body. In order to ensure that the thermal conduction path through the connection flange 15 is of sufficiently high resistance, in some especially preferable embodiments the length of that conduction path between the diffuser body 14 and the header plate 10 is substantially greater than the thickness of the connection flange. As an example, in some embodiments (such as the embodiment of FIGS. 3-4), the conduction path length through the connection flange 15 is at least three times the mean thickness of the connection flange 15.

The diffuser 3 of the embodiment of FIGS. 3-4 includes the connection flange 15 and the diffuser body 14 as a single integral component. By way of example, the diffuser 3 can be provided as a single piece produced by a casting process. In other embodiments, the diffuser can include two or more components to define the diffuser body and the connection flange. Several such alternative embodiments will next be described, with reference to FIGS. 5-9. In general, identical numbering is used for those features depicted in FIGS. 5-9 that are relatively unchanged from those shown in FIG. 4, while modified features have numberings that are increased by multiples of 100 from their equivalents of FIG. 4.

The embodiments of FIGS. 5-9 contemplate various inlet diffuser configurations having multiple piece constructions. An inlet diffuser 103, shown in FIG. 5, has a first component 103*a* joined to a second component 103*b*. The component 103*a* defines the diffuser body 114, whereas the component 103*b* defines the connection flange 115. The connection flange 115 again has an "L" shaped profile that joins to the diffuser body 114 at a location between the end 7 and the end 13. The joint between the component 103 and the component 103*b* can be a welded joint, a brazed joint, a glued joint, or some other type of joint known in the art. In some embodiments the component 103*b* can be formed from sheet metal, by stamping or drawing for example.

Figure 6:
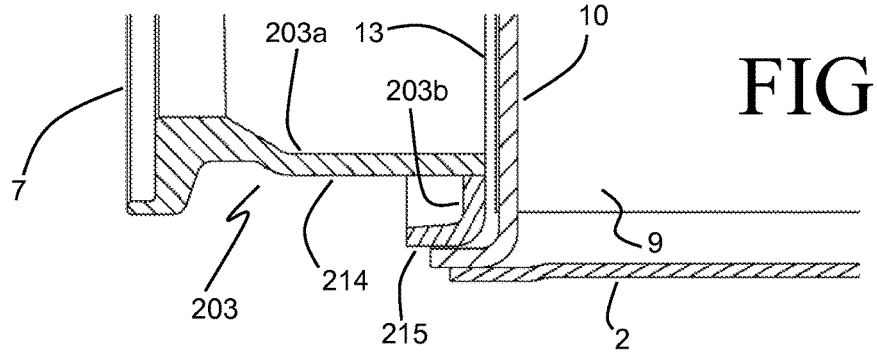

The diffuser 203 shown in FIG. 6 is of a similar construction, with a component 203*a* (defining the diffuser body 214) joined to an "L" shaped component 203*b* (defining the connection flange 215). In this specific embodiment the joint between the components 203*a* and 203*b* is located at the end 13 of the diffuser.

Figure 7:
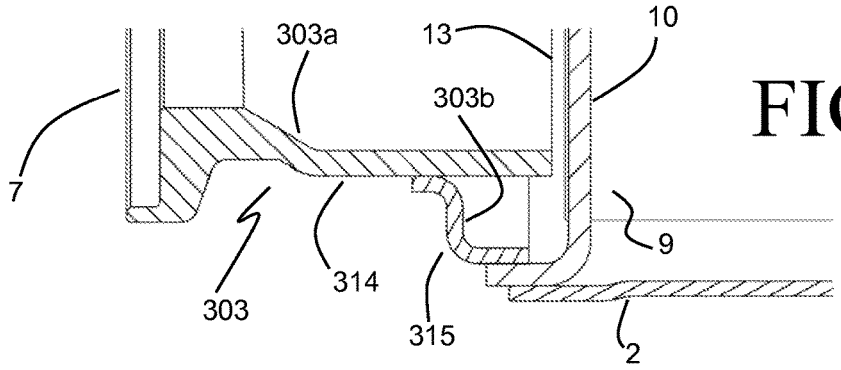

In the embodiment of FIG. 7, the inlet diffuser 303 includes a first component 303*a* and a second component 303*b*. The component 303*a* is similar to the previously defined components 103*a* and 203*a*. The component 303*b* defines a "Z" shaped profile, and the diffuser body 314 is defined by the component 303*a* and a portion of the component 303*b*, that portion of the component 303*b* serving to increase the thickness of the diffuser body 314 at the joint location.

Figure 8:
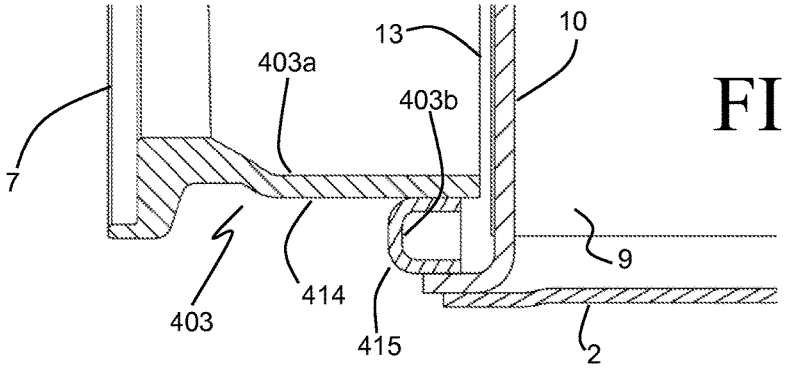
Figure 9:
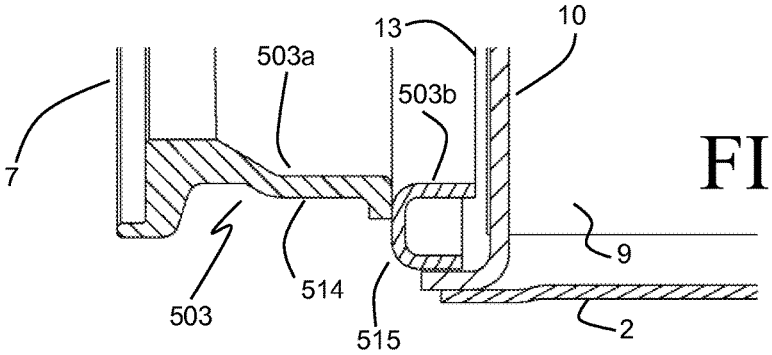

FIG. 8 and FIG. 9 depict two embodiments wherein a second component of the diffuser defines a "U" shaped profile. In the embodiment of FIG. 8, the diffuser 403 includes a first component 403*a* that extends from the inlet end 7 to the outlet end 13, similar to the components 103*a*, 203*a*, and 303*a* of the earlier described embodiments. The component 403*a* at least partially defines the diffuser body 414. The diffuser 403 further includes a second component 403*b* that defines the "U" shaped profile. In similar fashion to the component 303*b* of the embodiment of FIG. 7, the component 403*b* partially defines the diffuser body 414 by increasing the thickness of the diffuser body 414 at a select location. Specifically, the component 403*b* increases the thickness of the diffuser body 414 at the external surface of the diffuser body 414, between the end 13 and the location of the connection between the diffuser body 414 and the connection flange 415.

The alternative embodiment of FIG. 9 shows a diffuser 503 that includes a first component 503*a* and a second component 503*b*. The component 503*a* extends from the exhaust inlet 7 to the location of the joint connection between the diffuser body 414 and the connection flange 415, and defines the diffuser body 514 over that portion of the diffuser 503. The "U" shaped component 503*b* defines both the connection flange 515, and the diffuser body 514 between the joint connection location and the end 13.

Figure 10:
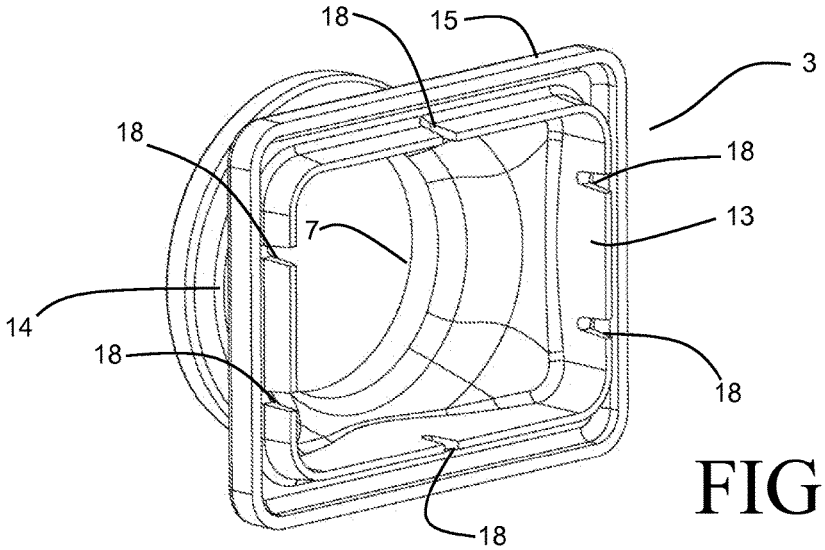
FIG. 10 is a perspective view of a diffuser according to another embodiment of the invention.

Yet another embodiment of the diffuser 3 is illustrated in FIG. 10. The embodiment of FIG. 10 includes multiple notches 18 arranged along the periphery of that portion of the diffuser body 14 that is located between the end 13 and the location of the connection between the diffuser body 14 and the connection flange 15. These notches 18 provide discontinuities to prevent the warping of that portion of the diffuser body 14 that might otherwise result from the increased thermal expansion of that portion relative to the connection flange portion of the diffuser 3. The notches 18 extend only through surface that are located inwardly of the sealed perimeter of the exhaust gas inlet plenum, and therefore do not present a leak path for the exhaust gas contained therein. By maintaining a relatively small size and number of the notches 18, the inner surfaces 19 of the connection flange 15 can still be substantially shielded from the flow of exhaust gas.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. An exhaust gas cooler comprising:

a plurality of tubes to convey an exhaust gas flow through the cooler;

a casing surrounding the plurality of tubes;

a header plate to receive ends of the plurality of tubes, the header plate including a middle portion with slots that receive the ends, a periphery around the middle portion, and a collar extending from the periphery;

a single wall diffuser, the diffuser and the header plate together defining an inlet plenum for the exhaust gas flow, the diffuser extending from a diffuser inlet end to a diffuser outlet end, the diffuser outlet end being proximal to the middle portion of the header and the diffuser outlet end extending in a direction away from the periphery; and a connection flange located at least partially within the inlet plenum and extending from the diffuser to the collar of the header plate to join the diffuser to the header plate, the connection flange being continuously connected to the diffuser around an outside surface of the diffuser proximal to the diffuser outlet end, having a first flange end that joins with the diffuser at a first location nearer to the diffuser outlet end than to the diffuser inlet end, and having a second flange end, the second flange end located proximal to a second location where the connection flange is fixedly joined to the collar of the header plate, wherein at least a portion of the connection flange and at least a portion of the header plate are substantially shielded from the exhaust gas flow passing through the inlet plenum, and wherein the inlet plenum is further defined by a space between the header plate and the connection flange.

2. The exhaust gas cooler of claim 1, wherein the first location is between five millimeters and twenty millimeters from the diffuser outlet end.

3. The exhaust gas cooler of claim 1, wherein the inlet plenum extends around an exhaust gas outlet end of the diffuser, and the diffuser is sealed along a perimeter of the diffuser by a joint between the connection flange and the header plate.

4. The exhaust gas cooler of claim 1, wherein the inlet plenum is further defined by a space between the plurality of tubes and the connection flange.

5. The exhaust gas cooler of claim 1, wherein the diffuser includes an exhaust gas inlet end and an exhaust gas outlet end, and wherein the exhaust gas outlet end is located closer to the exhaust gas inlet end than at least one long side of one tube of the plurality of tubes.

6. The exhaust gas cooler of claim 5, wherein the exhaust gas outlet end is spaced apart from the header plate, the casing and the connection flange.

7. The exhaust gas cooler of claim 6, wherein a continuous wall includes a first portion that extends outwardly from the diffuser and is joined thereto and a second portion joined to both the first portion and the header plate and arranged at an angle to the first portion, and wherein an open space is defined between the exhaust gas outlet end and an end of the second portion located opposite the first portion.

8. The exhaust gas cooler of claim 1, wherein the connection flange is L-shaped having a first portion connected to the diffuser and a second portion extending from the first portion to the header plate and joined to the header plate, wherein the first portion is spaced from the header plate, and wherein the first portion is fluidly sealed to the diffuser.

9. An exhaust gas cooler having a plurality of tubes to convey an exhaust gas flow, a header plate to receive ends of the plurality of tubes, and a diffuser, the diffuser comprising:

an inlet end to receive the exhaust gas into the cooler;

an outlet end to deliver the exhaust gas to the plurality of tubes;

a diffuser body extending between the inlet end and the outlet end; and a connection flange joined to the header plate, the connection flange including a first portion connected to the diffuser body at a location between the inlet end and the outlet end and a second portion spaced from the diffuser body, the first portion extending radially outward from the diffuser body and the second portion extending toward the outlet end of the diffuser body.

10. The exhaust gas cooler of claim 9, wherein the joint between the connection flange and the header plate defines a continuous leak-free seal for the exhaust gas and wherein connection flange is fluidly sealed to the diffuser body.

11. The exhaust gas cooler of claim 9, wherein said location between the inlet end and the outlet end is between five millimeters and twenty millimeters from the outlet end.

12. The exhaust gas cooler of claim 9, wherein the connection flange is joined to the header plate at the second portion, and wherein the second portion of the connection flange extends substantially perpendicular to the first portion.

13. The exhaust gas cooler of claim 9, wherein the connection flange defines a conduction path length between the diffuser body and the header plate, the conduction path length being at least three times the mean thickness of the connection flange.

14. The exhaust gas cooler of claim 9, wherein the connection flange and the diffuser body are an integral casting, and wherein the first portion of the connection flange extends substantially perpendicular to the diffuser body.

15. The exhaust gas cooler of claim 9, wherein the connection flange is joined to the header plate by a continuous weld joint at the location between the inlet end and the outlet end.

16. An exhaust gas cooler comprising:

a plurality of conduits to convey an exhaust gas flow through the cooler;

a header plate to receive ends of the conduits;

a case surrounding the plurality of conduits;

a diffuser connected to the header plate to define an inlet plenum for the exhaust gas flow, the diffuser extending from a diffuser inlet end to a diffuser outlet end; and a connection flange including a continuous wall that is connected to an outside surface of the diffuser at a first location proximal to the diffuser outlet end, and is connected to the header plate at a second location, and includes an angle between the first location and the second location;

wherein the diffuser extending toward the header plate extends past the first location and past the second location, wherein the continuous wall is continuously connected to the diffuser at the first location to form a seal between the continuous wall and the diffuser, wherein at least a portion of the continuous wall extends in a different direction than the diffuser, wherein an inside surface of the diffuser at least partially defines a first portion of the inlet plenum, and the outside surface of the diffuser and the continuous wall at least partially define a second portion of the inlet plenum, wherein the first portion defines a flow path between the exhaust gas inlet end and an exhaust gas outlet end of the diffuser, and wherein the second portion is radially spaced from the flow path.

17. The exhaust gas cooler of claim 16, wherein the connection flange connects the diffuser to the header plate at an inside surface of the header plate such that the diffuser is located at least partially within the header plate.

18. The exhaust gas cooler of claim 16, wherein the case is connected to the header plate at an outside surface of the header plate.

19. The exhaust gas cooler of claim 16, wherein the diffuser includes at least one notch at the diffuser outlet end.

20. The exhaust gas cooler of claim 19, wherein the diffuser outlet end includes a plurality of sides and each of the plurality of sides includes the at least one notch.

* * * * *